United States Patent [19]

Cramer

[11] Patent Number: 4,767,034

[45] Date of Patent: Aug. 30, 1988

[54] SCRUBBER CAP CLOSURE

[75] Inventor: Ronald G. Cramer, Racine, Wis.

[73] Assignee: S. C. Johnson & Son, Inc., Racine, Wis.

[21] Appl. No.: 896,038

[22] Filed: Aug. 13, 1986

Related U.S. Application Data

[63] Continuation-in-part of Ser. No. 836,194, Feb. 25, 1986.

[51] Int. Cl.[4] ..... B22D 37/00

[52] U.S. Cl. ..... 222/525; 15/106; 222/191; 222/192

[58] Field of Search ..... 222/522, 525, 521, 519, 222/212, 206, 509, 562, 507, 182, 191, 192; 215/316, 321; 15/106, 236; 401/139

[56] References Cited

U.S. PATENT DOCUMENTS

| | | | |
|---|---|---|---|
| 1,595,323 | 8/1926 | Van Sant, Jr. | 15/106 |
| 1,595,324 | 8/1926 | Van Sant | 15/105 |
| 1,595,326 | 8/1926 | Van Sant | 15/106 |
| 1,646,324 | 10/1927 | Stewart . | |
| 1,685,727 | 9/1928 | Stewart | 132/112 |
| 1,958,434 | 5/1934 | Hartog | 221/62 |
| 2,037,922 | 4/1936 | Punte | 221/62 |
| 2,808,184 | 10/1957 | Vanko | 222/525 |
| 2,823,836 | 2/1958 | Bach | 222/521 |
| 2,944,273 | 7/1960 | Harris | 15/105 |
| 2,969,168 | 1/1961 | Newby | 222/525 |
| 2,974,835 | 3/1961 | Herbrick | 222/507 |
| 2,998,902 | 9/1961 | Thomas et al. | 222/525 |
| 3,011,499 | 12/1961 | Tajan | 132/112 |
| 3,012,698 | 12/1961 | Wiederquist et al. | 222/212 |
| 3,032,240 | 5/1962 | Dunklee | 222/525 |
| 3,090,067 | 5/1963 | Weiby et al. | 15/236 |
| 3,185,351 | 5/1965 | Klun | 222/182 |
| 3,227,332 | 1/1966 | Gowdy et al. | 222/525 |
| 3,276,640 | 10/1966 | Kessler | 222/525 |
| 3,587,937 | 6/1971 | Childs | 222/213 |
| 3,794,213 | 2/1974 | Schwartzman | 222/107 |
| 3,885,712 | 5/1975 | Libit | 222/153 |
| 4,314,656 | 2/1982 | Kessler | 222/525 |

OTHER PUBLICATIONS

"Shout TM Laundry Stain Remover", Bulletin No. ED2-11, 4 pp. S. C. Johnson & Son, Inc. Racine, WI.

"100 Years of Quality, Johnson Wax Household Products", Bulletin No. ADV. 502-205A, 12 pp., Shout TM Laundry Stain Remover Bottles and Can on p. 5.

*Primary Examiner*—Joseph J. Rolla
*Assistant Examiner*—Kenneth Noland

[57] ABSTRACT

A scrubber cap assembly comprising a spout and a dispensing cap of the push-pull type for use on a container containing a liquid material wherein the dispensing cap has a generally flat top surface and a skirt extending outwardly and downwardly from the top surface. A scrubbing means is constructed and arranged in a stepped configuration on the exterior of the skirt of the cap. The scrubber cap is pulled open and a liquid material is sprayed on the desired surface, the scrubber cap is then pushed closed and the liquid material is scrubbed into the sprayed surface with the scrubber portion of the cap. The scrubber cap assembly provides a simple, reliable, and inexpensive push-pull dispensing cap closure having a scrubber means constructed therein.

3 Claims, 1 Drawing Sheet

SCRUBBER CAP CLOSURE

CROSS-REFERENCE TO RELATED APPLICATION

This is a continuation-in-part of design application Ser. No. 836,194, filed on Feb. 25, 1986 still pending.

FIELD OF INVENTION

The present invention relates generally to a dispensing cap assembly for dispensing a liquid material from a container. More specifically, the invention relates to a dispensing cap assembly of the push-pull type which contains a dispensing cap having scrubber means for use with a container containing a liquid, such as a liquid prespotter.

BACKGROUND OF INVENTION

A wide variety of dispensing cap assemblies are known in the art for dispensing liquid materials from containers and for closing the container after dispensing. Further, dispensing cap assemblies are known in the art which are closed by pushing a cap down and opened by pulling a cap up, generally referred to as a push-pull type dispensing cap. For example, U.S. Pat. No. 3,032,240 discloses an assembly using a dispensing cap of the push-pull type having a container, a body member attached to the container, and a cap member attached to the body member for longitudinal frictional sliding adjustment on the body member to open and close the dispenser. Additional push-pull type assemblies are disclosed in U.S. Pat. Nos. 2,037,922; 2,974,835; 2,998,902; 3,227,332; and 3,885,712.

It is also known in the art to provide dispensing containers with a scrubbing or massaging element of a specific structure for scrubbing or massaging of the dispensed material. For example, U.S. Pat. Nos. 1,595,323; 1,685,727; 3,011,499; and 3,185,351 disclose dispensers with various scrubbing elements.

Further, liquid prespotters are generally known in the detergent art. Normally, the user will spray the prespotter on the fabric having a spot or stain and then rub the prespotter into the spot with his or her fingers or with a brush or by rubbing the fabric together.

Prior to the present invention, there have been no push-pull dispensing cap assemblies having a scrubbing means constructed in the cap which will allow the dispensing of a liquid, closing of the dispensing cap, and scrubbing of the dispensed liquid with the scrubbing means of the cap. Further, the prior art push-pull cap assemblies have not provided a scrubber cap closure which includes a practical and reliable means for sealing the dispensing spout when the dispensing cap is closed and for dispensing the liquid when the dispensing cap is opened.

OBJECTS OF THE INVENTION

A principal object of the present invention is to provide an improved scrubber cap assembly of the push-pull type for the dispensing of a liquid material, such as a prespotter, and for scrubbing the liquid material into the desired surface.

Another object of the invention is to provide a scrubber cap assembly of the push-pull type whereby the user can open a container containing a liquid material, such as a prespotter, spray the desired surface, such as a soiled fabric or the like, and thereafter close the container and scrub the liquid material into the sprayed surface without the release of further liquid from the container.

A further object of the invention is to provide a scrubber cap assembly of the push-pull type whereby the user can close a liquid containing container and scrub a desired surface with the scrubbing means of the cap while the container is in an inverted position without release of liquid material from the container.

A further object of the invention is to provide an improved push-pull type scrubber cap assembly which is simple and inexpensive to manufacture and which provides an attractive appearance to the user.

These and other objects of this invention will be apparent from the descriptions of this invention that follow.

SUMMARY OF THE INVENTION

The scrubber cap assembly of the present invention comprises a dispensing cap of the push-pull type for use on a container containing a liquid material wherein the dispensing cap has a generally flat top surface with a discharge opening therein and a skirt extending outwardly and downwardly from the top surface. A scrubbing means is constructed and arranged in a stepped configuration in the skirt of the cap. When the scrubber cap is pulled open, the liquid material, for example a liquid prespotter, is sprayed on the desired surface, the scrubber cap is then pushed closed, and the liquid material is scrubbed into the sprayed surface with the scrubber portion of the cap.

The scrubber cap assembly, which includes a stationary spout, is used in combination with a liquid containing container. More particularly, the combination comprises a container having a discharge neck, a spout connected to the discharge neck of the container, and a scrubber cap which is connected to and overlies the spout for longitudinal, frictional sliding adjustment on the spout to open and close discharge openings in both the spout and the cap in a push-pull manner. The spout comprises a base portion having a means for connection to the container; an intermediate portion which is cylindrical and extends upwardly from the base portion, the intermediate portion having a peripheral indentation of substantial width having an upper lip and a bottom shoulder; and an upper portion extending upwardly from the intermediate portion of lesser diameter than the intermediate portion and having a closed outer end and one or more discharge openings in its side.

The scrubber cap, which engages the spout in frictional, longitudinal sliding relation, comprises a generally flat top having one or more discharge openings therein and a skirt which extends outwardly and downwardly from the top to overlie the spout. A plurality of steps are constructed and arranged in the skirt of the cap to serve as a scrubbing means and provide an attractive appearance to the dispenser. Extending downwardly from the top of the scrubber cap is an annular sleeve which surrounds the spout. Connected to an inner wall of the annular sleeve by an annular ring is an inverted cup having one or more discharge openings therein. The annular ring and the inverted cup seals the discharge opening of the spout when the scrubber cap is pushed down, i.e., in the closed position. The annular sleeve further includes an inwardly extending rib beneath the inverted cup which projects into the peripheral indentation in the intermediate portion of the spout for frictional, longitudinal sliding engagement within the indentation between the upper lip and bottom shoulder of the indentation.

DETAILED DESCRIPTION OF PREFERRED EMBODIMENT

Figure 1:
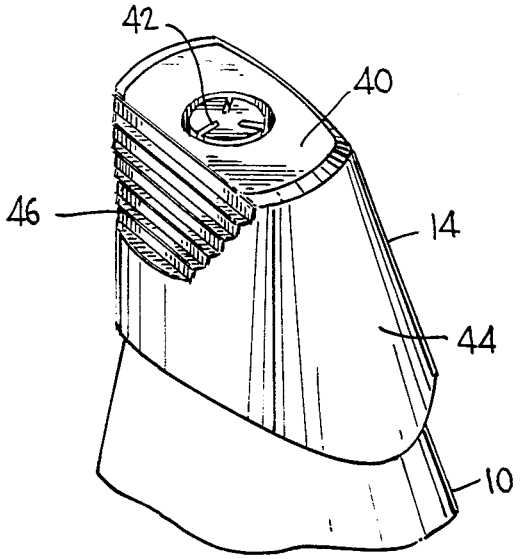
FIG. 1 is a perspective view of the scrubber cap in accordance with the invention.
Figure 2:
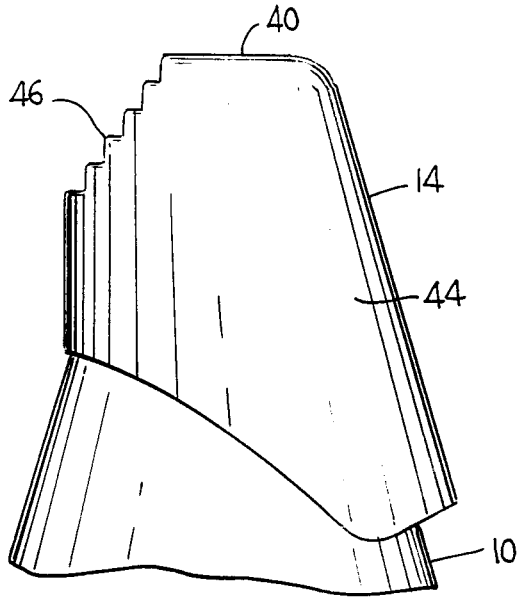
FIG. 2 is a side elevational view of the scrubber cap of FIG. 1.
Figure 3:
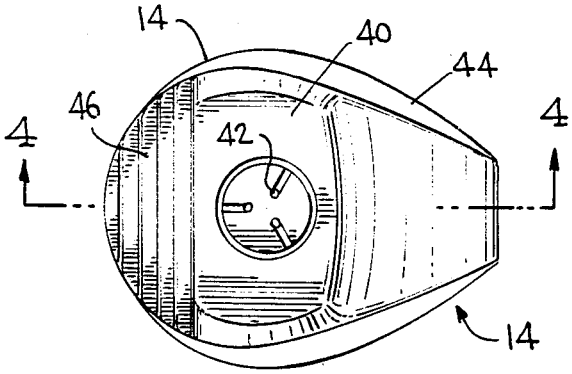
FIG. 3 is a top plan view of the scrubber cap of FIG. 1.
Figure 4:
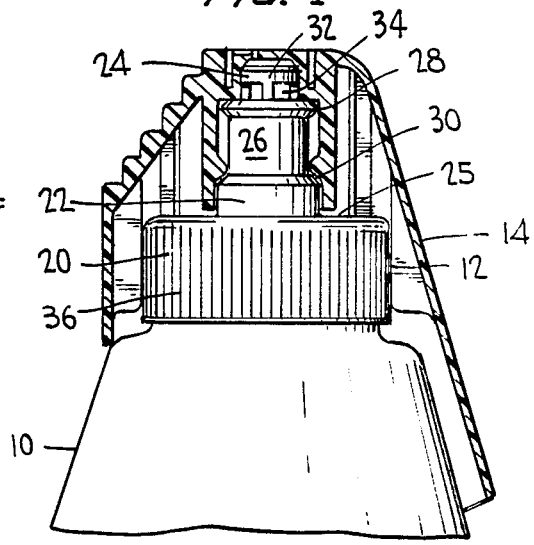
FIG. 4 is a sectional view of the scrubber cap taken through lines 4—4 of FIG. 3 showing the cap in the closed position.
Figure 5:
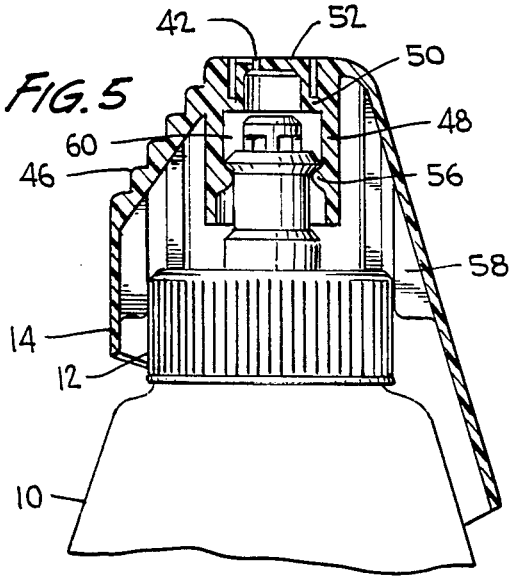
FIG. 5 is a sectional view of the scrubber cap taken through line 4—4 of FIG. 3 showing the cap in the open position.

Referring to FIGS. 1, 2, and 3, numeral 14 generally designates the scrubber cap of the invention. FIGS. 4 and 5 illustrate in cross-section the scrubber cap 14 of the invention in combination with container 10 and spout 12 shown in full.

Container 10 is preferably a squeeze container whereby the user places pressure on the sides of the container for the dispensing of a liquid, such as a liquid prespotter. The container may be made of any suitable material and is preferably made of a resilient plastic. Container 10 has a threaded discharge neck (not shown) for connection of the spout 12 which is held in a stationary position on the container, although other connecting means may be used such as disclosed in U.S. Pat. No. 3,032,240.

Spout 12, as shown in FIGS. 4 and 5, is preferably in one piece and is made of any suitable material, the preferred material being plastic. Spout 12 is generally comprised of a base portion 20, an intermediate portion 22, and an upper portion 24. Base 20 is internally threaded to engage the threaded neck of container 10 and has shoulder 25 on which intermediate portion 22 is supported. Intermediate portion 22 is generally cylindrical, extends upwardly and outwardly from base portion 20, and includes a peripheral indentation 26 of substantial width to form a lip 28 and shoulder 30 for frictional, longitudinal sliding engagement of rib 56 of scrubber cap 14. Upper portion 24 extends upwardly from the intermediate portion and is of substantially lesser diameter than the intermediate portion. Upper portion 24 has a closed outer end 32 and discharge side openings 34. The spout 12 is constructed for receipt in a generally mating relation with scrubber cap 14. Base portion 20 may include a plurality of grooves 36 to aid in attaching the spout to the container.

Figure 6:
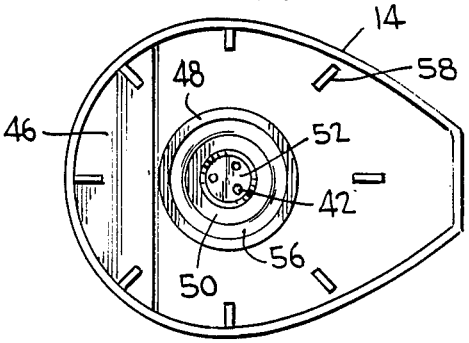
FIG. 6 is a bottom view of the scrubber cap of the invention.

Now referring collectively to FIGS. 1 through 6, it is seen that scrubber cap 14 is in one piece and comprises a generally flat top 40 having discharge openings 42 and a skirt 44 which extends outwardly and downwardly from top 40. The skirt 44 overlies spout 12 and preferably, as shown, overlies the discharge neck and a portion of container 10. Skirt 44 also includes a plurality of steps 46 which serve as a scrubbing means. Extending downwardly from top 40 is an annular sleeve 48. Connected within sleeve 48 by a continuous annular ring 50 is an inverted cup 52. The annular ring 50 and inverted cup 52 close discharge openings 34 of spout 12 when the scrubber cap is pushed down as shown in FIG. 4. As best shown in FIGS. 3 and 6, inverted cup 52 has one or more openings 42 for dispensing of a liquid. Extending inwardly from within sleeve 48 and below inverted cup 52 is an annular rib 56 which projects into peripheral indentation 26 of spout 12. Rib 56 functions to secure scrubber cap 14 on spout 12 as lip 28 precludes removal of the scrubber cap under normal pressure. Rib 56 also frictionally engages indentation 26 and is longitudinally slideable in indentation 26 for opening and closing the dispenser in a push-pull manner. A plurality of guides 58 extend inwardly from the interior of skirt 44 of scrubber cap 14 to seat in grooves 36 of base portion 20 and provide additional means for securing cap 14 to spout 12. Referring again to FIG. 5, when the scrubber cap is pulled open a cavity 60 results for receiving liquid from discharge openings 34 of spout 12. The liquid is dispensed from cavity 60 through openings 42 of cap 14.

Having described a preferred embodiment of the invention, the operation of the invention will now be described. Scrubber cap 14 is attached to spout 12 by placing sleeve 48 over upper portion 24 of spout 12 and by applying substantial pressure to force rib 56 over lip 28. Rib 56 frictionally engages peripheral indentation 26 in a longitudinal sliding relation allowing scrubber cap 14 to slide longitudinally on indentation 26 by applying an average amount of pressure. Lip 28 and shoulder 30 prevent rib 56 from movement outside of indentation 26 absent substantial pressure. As shown in FIG. 4, when scrubber cap 14 is pushed down, i.e., in closed position; rib 56 will seat on shoulder 30 of indentation 26, and annular ring 50 and inverted cup 52 will seat in openings 34 to prevent dispensing through spout 12. Further, outer end 32 will seat in inverted cup 52 to further prevent release of liquid through discharge openings 42. As shown in FIG. 5, when cap 14 is pulled up, i.e., in open position; rib 56 seats on lip 28 and discharge openings 34 are free to dispense a liquid to cavity 60 and the dispensed liquid is released as a spray through openings 42 to a desired surface. After spraying, scrubber cap 14 is placed in the closed position as shown in FIG. 4 and the user may scrub a liquid dispensed, such as a liquid prespotter, into a sprayed surface with scrubber steps 46.

While in the foregoing specification the invention has been described in relation to certain preferred embodiments and many details have been set forth for the purpose of illustration, it will be apparent to those skilled in the art that the invention is susceptible to additional embodiments and variations and that certain details described herein can be varied without departing from the principles of the invention.

It is claimed:

1. A scrubber cap closure assembly of the push-pull type useful in dispensing a liquid from a container provided with a discharge neck comprising:

(a) a spout connected to said discharge neck of said container comprising (1) a base portion having a means for connection to said container, (2) an intermediate cylindrical portion extending upwardly from said base portion, said cylindrical portion having a peripheral indentation of substantial width having an upper lip and a lower shoulder, and (3) an upper portion extending upwardly from said intermediate cylindrical portion of a lesser diameter than said intermediate cylindrical portion, said upper portion having a closed outer end and one or more discharge openings in the side of said upper portion; and (b) a scrubber cap connected to said spout for frictional, longitudinal sliding adjustment thereon comprising (1) a generally flat top having at least one discharge opening therein, (2) a skirt which extends outwardly and downwardly from said top to overlie said spout, (3) a plurality of steps constructed on the exterior of said skirt, said steps being constructed and arranged to serve as a scrubbing means, and (4) an annular sleeve extending downwardly from said top, said sleeve having an annular ring extending inwardly from said sleeve and connected to an inverted cup for closing said discharge opening in said spout, said inverted cup having at least one discharge opening, said sleeve having an inwardly extending annular rib constructed and arranged beneath said inverted cup which projects into said peripheral indentation of said spout for frictional, longitudinal sliding engagement within said peripheral indentation between said upper lip and bottom shoulder of said peripheral indentation;

wherein when said scrubber cap is pulled up, liquid may be released from said spout through said scrubber cap and when said scrubber cap is pushed down, said annular ring and said inverted cup seat in said discharge opening of said spout to prevent release of liquid from said spout.

2. A scrubber cap closure assembly of the push-pull type useful in dispensing a liquid from a container provided with a discharge neck comprising:

(a) a spout means connected to said discharge neck;

(b) a scrubber cap connected to said spout means for frictional, longitudinal sliding adjustment thereon comprising (1) a generally flat top having at least one discharge opening therein, (2) a skirt which extends outwardly and downwardly from said top to overlie said spout means, (3) a plurality of steps constructed on the exterior of said skirt, said steps being constructed and arranged to serve as a scrubbing means, and (4) annular sleeve means comprising an annular sleeve extending downwardly from said top, said sleeve having an annular ring extending inwardly from said sleeve and connected to an inverted cup for closing said spout means, said inverted cup having at least one discharge opening therein, said sleeve having an inwardly extending annular rib constructed and arranged beneath said inverted cup which projects into said spout means for frictional, longitudinal sliding engagement with said spout means when connected thereto.

3. A method of applying a liquid prespotter to a soiled material comprising spraying the liquid prespotter on a soiled material or the like from a container having an inner dispensing spout and an outer scrubber cap closure of the push-pull type, closing the prespotter container, and then scrubbing the liquid prespotter into the soiled material with the scrubber cap closure of the prespotter container, said scrubber cap closure comprising a generally flat top having an opening therein, a skirt extending outwardly and downwardly from said top to overlie said dispensing spout, a plurality of steps constructed and arranged in the exterior of said skirt to serve as a scrubbing means, and annular sleeve means comprising an annular sleeve extending downwardly from said top, said sleeve having an annular ring extending inwardly from said sleeve and connected to an inverted cup for closing said spout means, said inverted cup having at least one discharge opening therein, said sleeve having an inwardly extending annular rib constructed and arranged beneath said inverted cup which projects into said spout means for frictional, longitudinal sliding engagement with said spout means when connected thereto.

* * * * *

UNITED STATES PATENT AND TRADEMARK OFFICE

CERTIFICATE OF CORRECTION

PATENT NO. : 4,767,034

DATED : August 30, 1988

INVENTOR(S) : Ronald G. Cramer

It is certified that error appears in the above-identified patent and that said Letters Patent is hereby corrected as shown below:

In Column 5, Line 31, the words "to prevent" should read --prevents--.

Signed and Sealed this

Fourteenth Day of February, 1989

*Attest:*

DONALD J. QUIGG

*Attesting Officer*

*Commissioner of Patents and Trademarks*